United States Patent [19]

Kim

[11] Patent Number: 4,974,421

[45] Date of Patent: Dec. 4, 1990

[54] PLASTIC PAN ASSEMBLY HAVING AN U-SHAPED SUPPORTING BRACKET FOR USE IN AIR CONDITIONERS AND REFRIGERATORS

[75] Inventor: Il Y. Kim, Alexandria, Va.

[73] Assignee: Permanent Solution Industries, Inc., Falls Church, Va.

[21] Appl. No.: 440,259

[22] Filed: Nov. 22, 1989

[51] Int. Cl.[5] ..... F25D 21/00

[52] U.S. Cl. ..... 62/272; 62/285

[58] Field of Search ..... 62/272, 285, 286, 287, 62/291

[56] References Cited

U.S. PATENT DOCUMENTS

| | | | |
|---|---|---|---|
| 1,950,344 | 3/1934 | Williams | 62/285 X |
| 1,975,066 | 9/1934 | Sanderson | 62/285 X |
| 4,597,269 | 7/1986 | Kim | 62/286 |
| 4,823,558 | 4/1989 | Kim | 62/272 |
| 4,862,704 | 9/1989 | Kim | 62/272 |
| 4,916,919 | 4/1990 | Kim | 62/285 X |

*Primary Examiner*—Lloyd L. King

*Attorney, Agent, or Firm*—Birch, Stewart, Kolasch & Birch

[57] ABSTRACT

A plastic primary pan assembly for use in conjunction with an air conditioning system which includes a C-shaped drain plastic pan, a pan cover having a raised portion disposed around a blow outlet thereof, and an U-shaped supporting bracket having a pair of locking end members and a pair of elongated channels and an elongated aperture being mounted on the fan cover and a motor through a motor plate, whereby the plastic primary pan assembly can be easily associated with and separate from the air conditioning system and easily adjusted to incline the plastic primary pan for draining condensate water through an outlet disposed in the plastic primary pan.

7 Claims, 2 Drawing Sheets

PLASTIC PAN ASSEMBLY HAVING AN U-SHAPED SUPPORTING BRACKET FOR USE IN AIR CONDITIONERS AND REFRIGERATORS

BACKGROUND OF THE INVENTION

1. Field of the Invention

The present invention relates to a primary plastic pan assembly for use in conjunction with air conditioning installations and refrigeration systems and more particularly, to a plastic primary pan assembled with an U-shaped supporting bracket which is mounted to a fan cover and a motor.

2. Description of the Prior Art

Primary pans are generally known to be utilized with air conditioning systems. Conventional devices utilize a primary pan made of steel which is directly mounted to a fan cover and a motor. However, these devices suffer from a number of problems such as, for example, the problem that metallic primary pans eventually become rusted and plug up outlets for draining water from the pan. Further, it is difficult for the pan to support the air condition system such as the motor and the pan cover, because of the additional weight caused by the metal pan, so that the motor cannot be used for a long time. It is also very difficult for the primary pans to separate from such devices because the structure is very complicated and device has a heavy weight.

In order to avoid such problems, U.S. Pat. No. 4,597,269, issued to the present inventor, discloses a plastic pan adapted to be mounted to the motor of an air conditioning system which includes a primary pan, a support bracket, height-adjustable brackets, and a motor mount bracket whereby the plastic pan avoids the plugging up of the outlet. However, this primary pan exhibits some problems with regard to convenient and reliable assembling and requires a lot of bolts for installation.

U.S. Pat. No. 4,823,558, issued to the present inventor, discloses a plastic pan assembly for use in air conditioning systems and refrigerators wherein a plastic pan having a raised portion or a rail disposed on the outside surface of the bottom thereof is easily engaged with a channeled supporting bracket. However, this pan assembly requires a large space for working.

U.S. Pat. No. 4,862,704, issued to the present inventor, discloses an improved primary pan for use in an air conditioning system which includes a C-shaped plastic pan having a raised portion or a rail disposed on the outside surface of the bottom thereof, a channeled supporting bracket having a plurality of elongated apertures for engaging the raised portion of the rail of the plastic pan, and a pair of fan covers having a channel disposed on the outside surface of the top and a circumferential raised portion disposed around a lower outlet thereof for effectively mounting to and separating from the supporting bracket to the plastic pan with only two pairs of screws. However, this pan assembly does not disclose the use of an U-shaped supporting bracket for easily receiving the plastic pan.

The present inventor is also prosecuting still another U.S. patent application Ser. No. 07/381,261, filed July 18, 1989, now Pat. No. 4,916,919 which discloses an improved primary pan for use in an air conditioning system wherein a channeled supporting bracket is utilized to tightly engage and effectively support a plastic pan which includes a drain plastic pan and a plastic support plate which contains a C-shaped circumferential portion and a C-shaped extending portion thereof, the channeled supporting bracket having a plurality of elongated apertures being mounted on a motor and a fan cover, whereby the plastic primary pan assembly can be easily associated with and separate from the air conditioning system and easily adjusted to incline the plastic primary pan for drawing condensate water through an outlet disposed in the plastic primary pan. However, this primary pan does not disclose the use of an U-shaped supporting bracket for easily receiving the plastic pan.

The present inventor is also prosecuting a further U.S. patent application Ser. No. 07/431,903, filed Nov. 6, 1989, which disclosed a plastic primary pan containing a pair of blind plates having a pair of semi-cylinders, respectively, to be removed one of them from the base primary pan, a pair of rubber packings, and an assembly plate having a pair of semi-cylinders to be inserted into the base primary pan, after taking out one of the pair of blind plates from the base primary pan, assembling with a base primary pan instead of the blind plate so as to pass a pair of built drain pipe therethrough, whereby the plastic primary pan can easily assemble the base primary pan with the assembly plate, the pair of rubber packings, and the pair of drain pipes. However, this pan assembly does not disclose the use of an U-shaped supporting bracket for easily receiving the plastic pan.

SUMMARY OF THE INVENTION

Accordingly, it is an object of the present invention to provide an improved plastic pan assembly for use in air conditioning systems and refrigerators.

Another object of the present invention is to provide a plastic primary pan which is structured for draining condensate water through an outlet while avoiding the plugging up of the outlet.

Still another object of the present invention is to provide an air conditioning system which includes an assembly for easily mounting a primary pan to an U-shaped supporting bracket which has a pair of locking end members and elongated channels disposed on the inside surface of a pair of arms thereof and which is mounted to a fan cover and a motor.

Yet another object of the present invention is to provide an improved primary pan for utilizing to a specific air conditioning system having a narrow width thereof.

A further object of the present invention is to provide an improved primary pan which can be readily mounted to an easily separated from an air conditioning system which includes a C-shaped drain plastic pan, an U-shaped supporting bracket having a elongated aperture for receiving a motor plate, and a fan cover having a raised portion disposed on the top circumferential portion of a blower outlet thereof for slidably attaching the C-shaped top circumferential portion of the drain plastic pan.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a plastic primary pan assembly for use in conjunction with an air conditioning system which includes a C-shaped drain plastic pan, a pan cover having a raised portion disposed around a blow outlet thereof, and an U-shaped supporting bracket having a pair of locking end members and a pair of elongated channels and an elongated aperture being mounted on the fan cover and a motor through a motor plate, whereby the plastic primary pan assembly can be easily associated with and separate from the air conditioning system and easily adjusted to incline the plastic primary pan for draining condensate water through an outlet disposed in the plastic primary pan.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
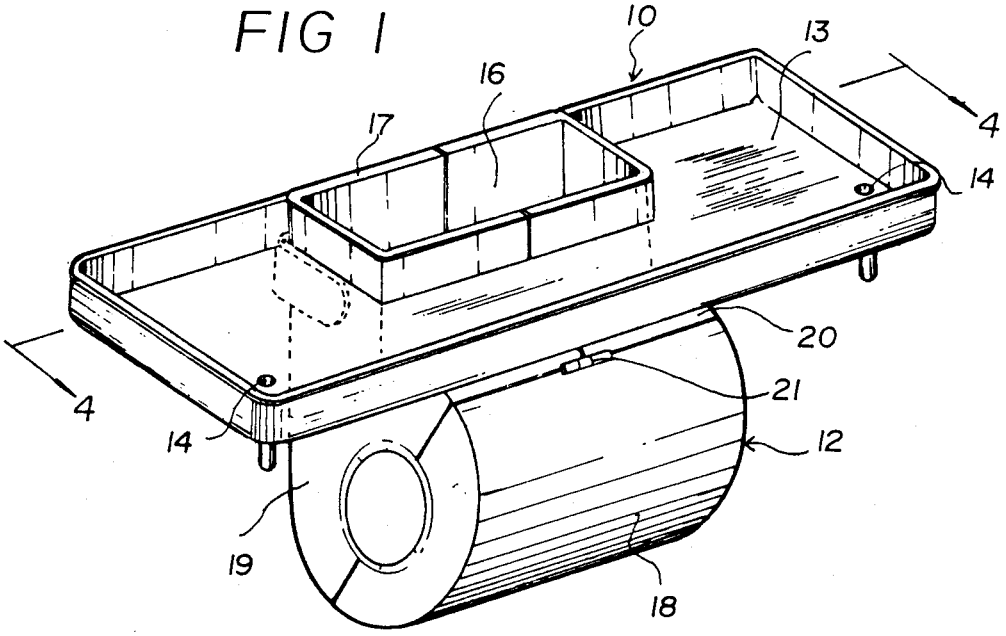
FIG. 1 is a perspective view of a plastic primary pan assembly with its associated pan cover according to the present invention.
Figure 2:
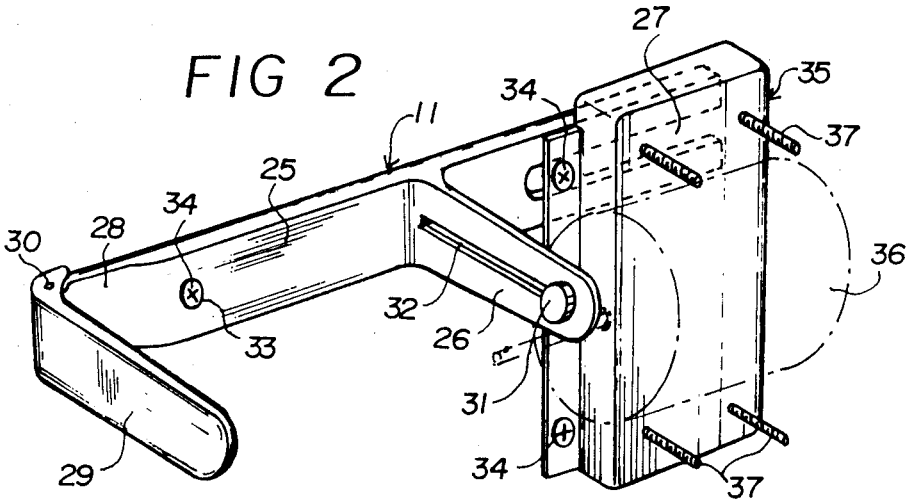
FIG. 2 is a perspective view of showing an U-shaped supporting bracket with its associated motor plate according to the present invention.
Figure 3:
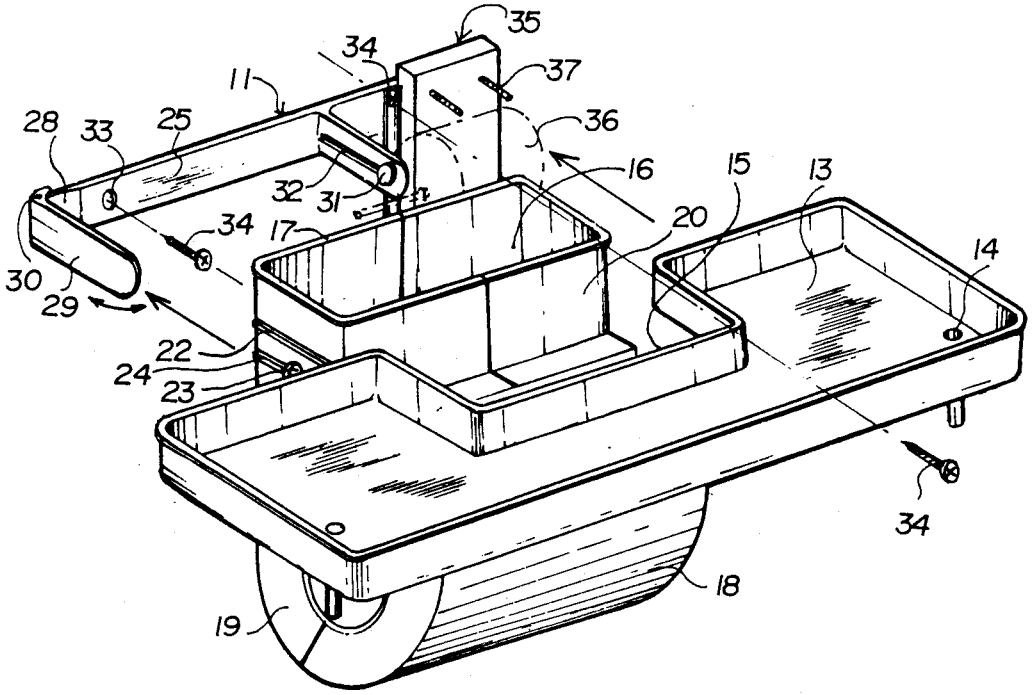
FIG. 3 is an exploded perspective view showing basic components of the plastic primary assembly according to the present invention.

Referring now in detail to the drawings for the purpose of illustrating preferred embodiments of the present invention, the plastic primary pan assembly as shown in FIGS. 1, 2, and 3 includes a C-shaped plastic primary pan 10, an U-shaped supporting bracket 11 which is mounted to a fan cover 12 and a motor 36.

The C-shaped plastic primary pan 12 is provided with a plastic pan body 13, a C-shaped portion 15 disposed at the one side thereof, and drain pipes 17 disposed in both end portions thereof for draining condensate water (FIG. 3).

The U-shaped supporting bracket 11 contains a T-shaped base 25 having a middle arm 26 extended from the middle portion, an elongated aperture 27 at one end for engaging a motor plate 35, and a thin portion 28 at the other end thereof, respectively. Also, the U-shaped supporting bracket 11 contains an edge arm 29 which is pivotably connected to the edge portion of the thin portion 28 thereof through a pivot pin 30 for inwardly bending about the pivot pin 30. The middle arm 26 and the edge arm 29 have a locking end member 31 having a raised portion and an elongated channel 32, respectively. The U-shaped supporting bracket 11 can easily be mounted to a wall of the housing of the air conditioners and refrigerators by a screw 34 through a screw aperture 33 disposed between the middle and edge arms 26 and 27, and a screw 34 through the elongated aperture 27 with the motor plate 35 (FIG. 2).

Figure 4:
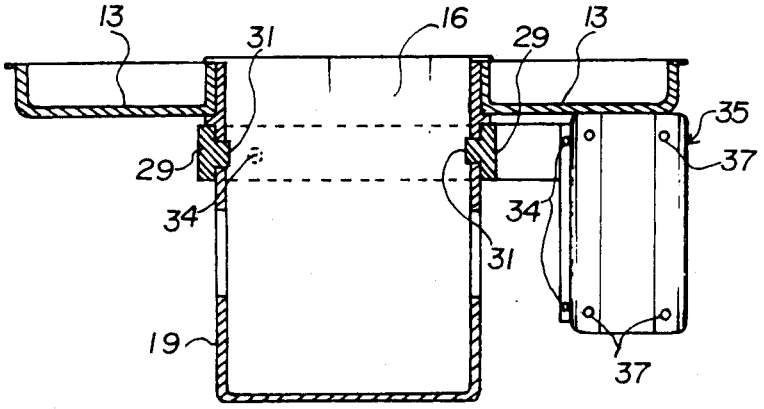
FIG. 4 is a sectional view of FIG. 1, taken along line 4—4, showing a pair of locking end members disposed on the U-shaped supporting bracket according to the present invention.

As shown in FIGS. 3 and 4, the fan cover 12 defined a right fan cover 20, a left fan cover 19, and a lower fan cover 18 contains a blow outlet 16 which has a top circumferential raised portion 17 for being adapted to suspend to the C-shaped circumferential portion 15 of the plastic primary pan 10. These three pan covers 18, 19, and 20 are assembled by an engagement 21 to form the plastic pan cover 12 for receiving a fan (not shown). Thus the left and right pan covers 19 and 20 include the circumferential raised portion 17 disposed around the top portion of the blow outlet 16 thereof for easily mounting to and separating from the C-shaped circumferential portion 15 of the plastic primary pan 10. Also, the formed blow outlet 16 is provided with a pair of raised portions 22 disposed on the outside wall thereof so as to form a pair of elongated slots between the circumferential raised portion 17 and the raised portions 22 for slidably inserting the C-shaped portion 15 of the C-shaped plastic primary pan 10 thereinto, and a pair of apertures 23 and elongated rails 24 for slidably locking with the pair of locking end members 31 and elongated channels 32 of the middle and edge arms 26 and 29.

As shown in FIG. 2, the motor plate 35 is provided with a plurality of motor screws 37 for being adapted to engage with a motor bracket (not shown) with the motor 36. Thus the motor 36 is provided with the motor plate 35 for being mounted to the supporting bracket 11 by the screw 34 through the elongated apertures 27 of the end portion of the supporting bracket 11. Accordingly, since the motor 36 is mounted to the supporting bracket 11, it is believed that the motor 36 can be maintained for a long time when compared with the motor utilized by the conventional air conditioning devices.

In assembly, as shown in FIGS. 3 and 4, the U-shaped supporting bracket 11 is attached to the wall of the housing of the air conditioning system with the inclination by the screws 34 through the apertures 33 and elongated aperture 27 of the supporting bracket 11 with the motor plate 35 for easily draining condensate water through one of the drain pipes 14. After the fan cover 13 containing a fan (not shown) is combined together with the pin engagement 21, the supporting bracket 11 is engaged with the combined fan cover 12 through the pair elongated slots of the left and right fan covers 19 and 20. At that time, the middle arm 26 and edge arm 29 are simultaneously locked with the pan cover 12 by tightly engaging the locking end members 31 and elongated channels 32 thereof with apertures 23 and elongated rails 24 of the pan cover 12 since the edge arm 29 is inwardly bent as indicated by the arrow shown in FIG. 3. And the motor 36 is mounted to the motor plate 35 by motor screws 37 through the motor bracket. Finally, the plastic primary pan 10 is assembled with the plastic pan cover 12 having the fan by inserting the C-shaped circumferential portion 15 thereof into the pair of elongated slots formed between the top circumferential raised portion 17 and the pair of raised portion 22 of the fan cover 12. Thus by using only three screws 34, the plastic pan assembly including the fan and the motor 36 can be easily mounted on the wall of the housing of the air conditioners and refrigerators.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A primary pan assembly for use in an air conditioning system which comprises:

a C-shaped plastic primary pan provided with a drainage hole disposed on at least one side thereof and a C-shaped circumferential portion disposed at one side thereof, a fan cover having a blow outlet, said fan cover including a circumferential raised portion disposed on the top of said blow outlet and a pair of elongated raised portions disposed on a pair of outside walls of said blow outlet so as to form a pair of elongated slots for inserting said C-shaped circumferential portion of the C-shaped primary pan, a pair of elongated rails disposed below said elongated raised portions, and a pair of apertures connected to said pair of elongated rails, an U-shaped supporting bracket including a T-shaped body, wherein the T-shaped body contains a middle arm extended therefrom, an elongated aperture disposed at one end thereof, and a thin portion disposed at the other end thereof, and an edge arm pivotably, inwardly connected to said middle arm by a pivotal pin, said middle and said edge arms provided with a locking end member and an elongated channel disposed on the outside surface thereof for tightly engaging with said apertures and elongated rails of the fan cover, and a motor mounted to said U-shaped supporting bracket by screws through a motor plate, whereby the primary pan assembly can be mounted to the housing wall of the air conditioner system at an inclination for easily draining the condensate water through the drainage hole.

2. The primary pan assembly of claim 1, wherein the U-shaped supporting bracket includes at least one aperture for tightly attaching to the housing wall of the air conditioning system by a screw through the aperture thereof.

3. The primary pan assembly of claim 1, wherein the motor plate includes a plurality of motor screws for attaching the motor to a motor bracket.

4. The primary pan assembly of claim 1, wherein the U-shaped supporting bracket is made of aluminum.

5. The primary pan assembly of claim 1, wherein the U-shaped supporting bracket is made of steel.

6. The primary pan assembly of claim 1, wherein the U-shaped supporting bracket is made of plastic.

7. The primary pan assembly of claim 1, wherein the fan cover is assembled with a right pan cover, a left pan cover and a lower fan cover by a pin engagement for easily inserting a fan thereinto.

* * * * *